United States Patent [19]

Shibukawa

[11] Patent Number: 4,982,644

[45] **Date of Patent: * Jan. 8, 1991**

[54] ELECTRONIC MUSICAL INSTRUMENT WITH TONE-SUSTAINING CONTROLLER

[75] Inventor: Takeo Shibukawa, Shizuoka, Japan

[73] Assignee: Yamaha Corporation, Hamamatsu, Japan

[ * ] Notice: The portion of the term of this patent subsequent to Aug. 22, 2006 has been disclaimed.

[21] Appl. No.: 372,475

[22] Filed: Jun. 28, 1989

Related U.S. Application Data

[63] Continuation of Ser. No. 149,685, Jan. 19, 1988, Pat. No. 4,858,508.

[30] Foreign Application Priority Data

Jan. 29, 1987 [JP] Japan ..... 62-19081

[51] Int. Cl.[5] ..... G10H 7/00; G10H 1/02

[52] U.S. Cl. ..... 84/627; 84/601; 84/602; 84/626

[58] Field of Search ..... 84/601-603, 84/626, 627, 662, 663, 701, 702, 622

[56] References Cited

U.S. PATENT DOCUMENTS

| | | | |
|---|---|---|---|
| 3,898,905 | 8/1975 | Schreier | 84/684 |
| 3,971,284 | 7/1976 | Schreier | 84/702 |
| 4,214,500 | 7/1980 | Adachi et al. | 84/700 |
| 4,357,849 | 11/1982 | Ezawa et al. | 84/617 |
| 4,388,851 | 6/1983 | Hoskinson et al. | 84/626 |
| 4,391,176 | 7/1983 | Niinomi | 84/663 X |
| 4,463,647 | 8/1984 | Luce | 84/684 |
| 4,493,237 | 1/1985 | DeLong et al. | 84/626 |
| 4,696,216 | 9/1987 | Asahi et al. | 84/609 |
| 4,703,680 | 11/1987 | Wachi et al. | 84/615 |
| 4,858,508 | 8/1989 | Shibukawa . | |

*Primary Examiner*—R. L. Moses

*Attorney, Agent, or Firm*—Burns, Doane, Swecker and Mathis

[57] ABSTRACT

For imparting a sostenuto effect to a series of sounds produced by key depressions successively repeated in an electronic musical instrument, a searching device searches a first memory device for a first memory channel which has already stored a note information identical with the note information produced on the basis of the repeated key depression, and, then a setting device is actuated in the presence of aforementioned first channel and operative to copy the sostenuto information indicative of the instruction of imparting the sostenuto effect from a second channel paired with aforementioned first channel having already stored the identical note information to the second channel paired with another first channel where the note information produced by the repeated key depression is newly stored, thereby imparting the sostenuto effect between tones produced by repeated key depressions.

2 Claims, 9 Drawing Sheets

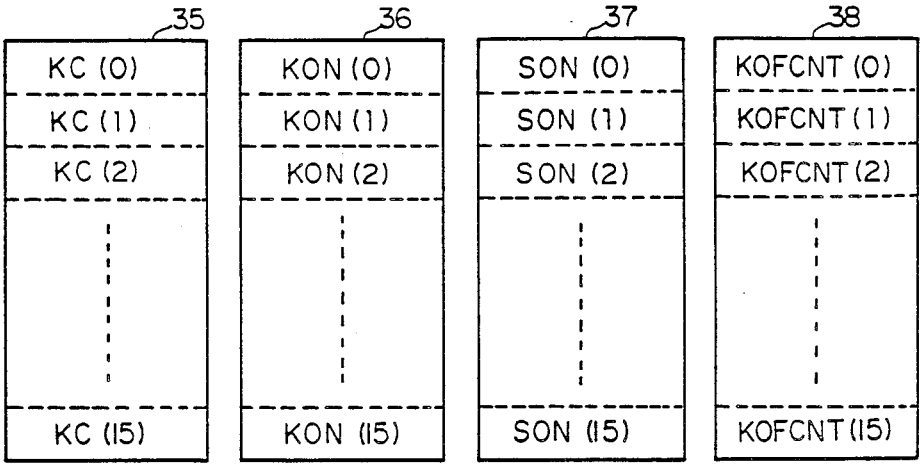
FIG.4A FIG.4B FIG.4C FIG.4D
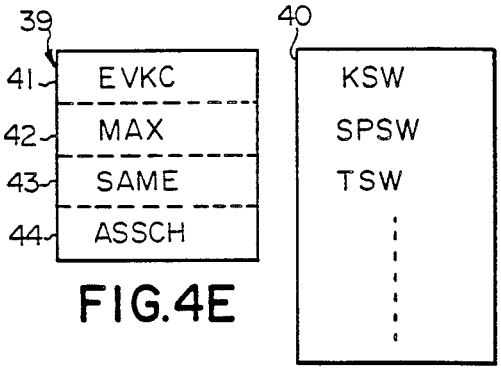
FIG.4E
FIG.4F

ELECTRONIC MUSICAL INSTRUMENT WITH TONE-SUSTAINING CONTROLLER

This application is a continuation, of application Ser. No. 07/149,685, filed Jan. 28, 1988. Now U.S. Pat. No. 4,858,508.

FIELD OF THE INVENTION

This invention relates to an electronic musical instrument and, more particularly, to an electronic musical instrument having a tone-sustaining effect similar to a sostenuto effect in an acoustic piano.

BACKGROUND OF THE INVENTION

A typical example of the electronic musical instrument is disclosed in Japanese Utility Model Publication (Kokoku) No. 59-13657 and is provided with a tone-sustaining controller which is operative to control the decay time period of a tone produced by a sound unit on the basis of a tone signal produced by a tone generator. Namely, upon depression of a key of the keyboard, a key state signal representative of the key operation is produced by a key switch circuit associated with the keyboard and is temporally stored in a latch circuit synchronous with an actuation of a tone-sustaining switch. In other words, the latch circuit is clocked by a timing signal produced upon actuation of the tone-sustaining switch for the synchronous latching operation. The key state signal stored in the latch circuit is ANDed with a switch-state signal representative of the actuated state of the tone-sustaining switch to produce an output signal indicative of allowing the tone to be elongated after key releasement. In so far as the key is depressed, the sound unit causes the intensity of the tone to gradually decay, and, upon key releasement during the decay time period, the sound unit rapidly terminates the production of the tone under inactivation of the tone-sustaining switch, however the sound unit sustains the production of the tone to decay in similar to that in the continuous key depression when actuating the tone-sustaining switch. Thus, the tone-sustaining controller incorporated in the prior-art electronic keyboard instrument is operative to change the decay time period of a tone and is capable of imparting a tone-sustaining effect or a sostenuto effect to the tone produced in the prior-art electronic keyboard instrument.

However, a problem is encountered in the prior-art tone-sustaining unit in ignoring the actuation of the tone-sustaining switch upon successive key depressions. In detail, the latch circuit temporally stores the key state signal upon actuation of the tone-sustaining switch, however the latch circuit ignores the subsequent key state signal fed thereto during continuous actuation of the tone-sustaining switch because of lack of the timing signal. This results in rapid termination of the tone produced upon the subsequent key operation even if the tone-sustaining switch is actuated.

SUMMARY OF THE INVENTION

It is therefore an primary object of the present invention to provide an electronic musical instrument which is capable of certainly imparting a tone-sustaining effect to tones produced in succession.

It is an important object of the present invention to provide an electronic musical instrument which is capable of imparting a tone-sustaining effect similar to a sostenuto effect in an acoustic piano.

It is also important object of the present invention to provide an electronic musical instrument which is capable of imparting a tone-sustaining effect to a series of tones even if a tone-sustaining switch continues to remain in the actuation state.

To accomplish these objects, the present invention proposes to make a copy of the sound-sustaining information of the previous key depression.

Referring first to FIG. 1 of the drawings, there is shown a functional relationship among component elements of the present invention. In accordance with the present invention, there is provided an electronic musical instrument for electronically producing sounds comprising (a) a keyboard 1 having a plurality of keys each movable between an undepressed state and a depressed state, the keyboard being operative to produce a note information representative of a note of a depressed state key, (b) first memory means 2 provided with a plurality of first channels each capable of storing the note information, (c) control means 3 operative to assign the note information to one of the first channels, (d) a sound-sustaining switch 4 operated by an operator and producing a switch state information alternatively representing an activated state and an inactivated state, (e) second memory means 5 provided with a plurality of second channels each paired with each of the first channels for storing a sound-sustaining information alternatively representing a first state and a second state, the first state being representative of a request for imparting a tone-sustaining effect to aforesaid one of the sounds, the second state being representative of an absence of the request, (f) searching means 6 operative to search, when a key is depressed, the first memory means 2 for a first channel which has already stored a note information identical with the note information of the depressed key, (g) first setting means 7 operative to set to the first state the sound-sustaining information stored in one of the second channels paired with the first channel supplied with the note information when the switch state information is in the activated state, the first setting means 7 further operative to set to the second state the sound-sustaining information stored in aforesaid one of the second channels when the switch state information is in the inactivated state, (h) second setting means responsive to the searching means so as to set the sound-sustaining information stored in aforesaid one of the second channels to the same state as the sound-sustaining information stored in a second channel paired with the first channel which has already stored the note information, and (i) sound generator means 9 operative to produce one of the sounds having the note specified by the note information, the sound generator means 9 further operative to impart the tone-sustaining effect to aforesaid one of the sounds when the tone-sustaining information stored in aforesaid one of the second channels is in the first state.

The electronic musical instrument may comprise third memory means provided with a plurality of third channels each related to each of the keys for storing a key state information alternatively representing a key-on state and a key-off state, thereby allowing the control means to assign the note information to aforesaid one of said first channels if the key state information is in the key-on state. The musical instrument may comprise fourth memory means for storing a switch state information alternatively representing an activation state of the tone-sustaining switch or an inactivation state of the tone-sustaining switch, thereby causing the first setting means to be ready for operation.

In another implementation, the electronic musical instrument may comprise fifth memory means provided with a plurality of fifth channels each paired with each of the first channels for storing a time information representative of a time period measuring from a moment of one of the keys from the depressed state to the undepressed state, thereby causing the control means to assign to a first channel the note information accompanied by the time information with the greatest value.

BRIEF DESCRIPTION OF THE DRAWINGS

The features and advantages of an electronic musical instrument according to the present invention will be more clearly understood from the following description taken in conjunction with the accompanying drawings in which:

FIGS. 4A to 4F are views showing the structure of memory system incorporated in the electronic musical instrument illustrated in FIG. 2;

DESCRIPTION OF THE PREFERRED EMBODIMENTS

Figure 1:
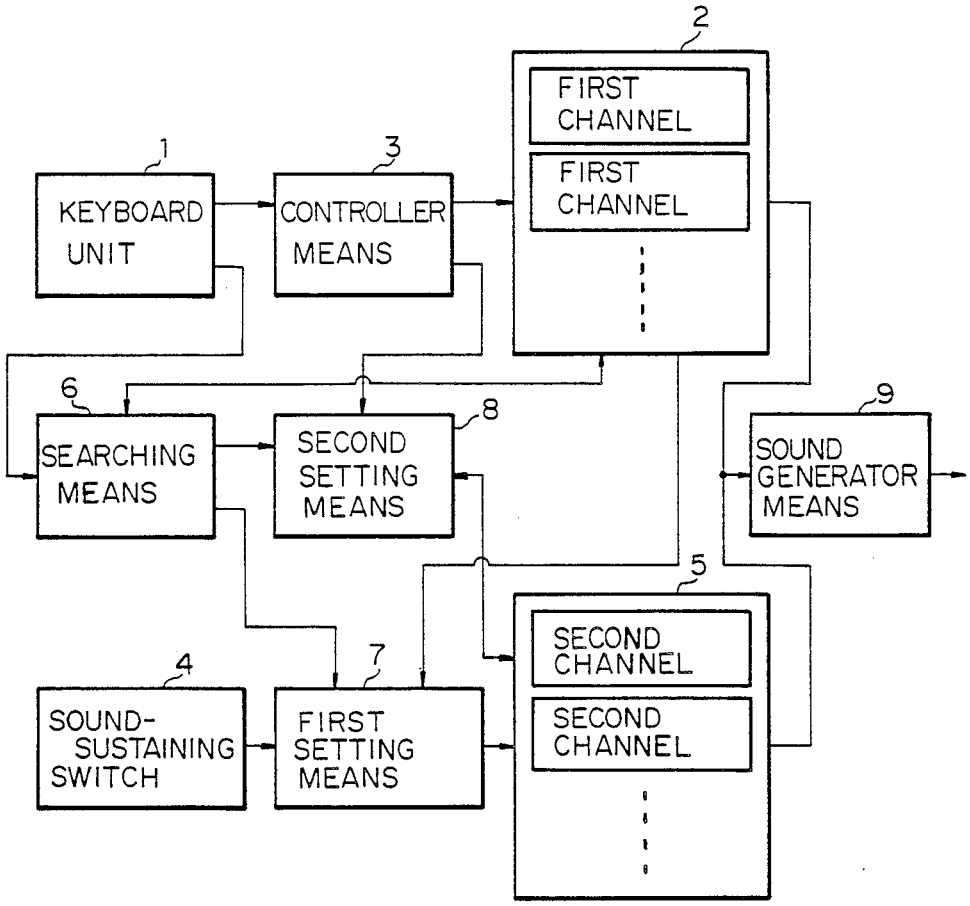
FIG. 1 is a block diagram showing the functional relationships among the component elements constituting an electronic musical instrument according to the present invention.
Figure 2:
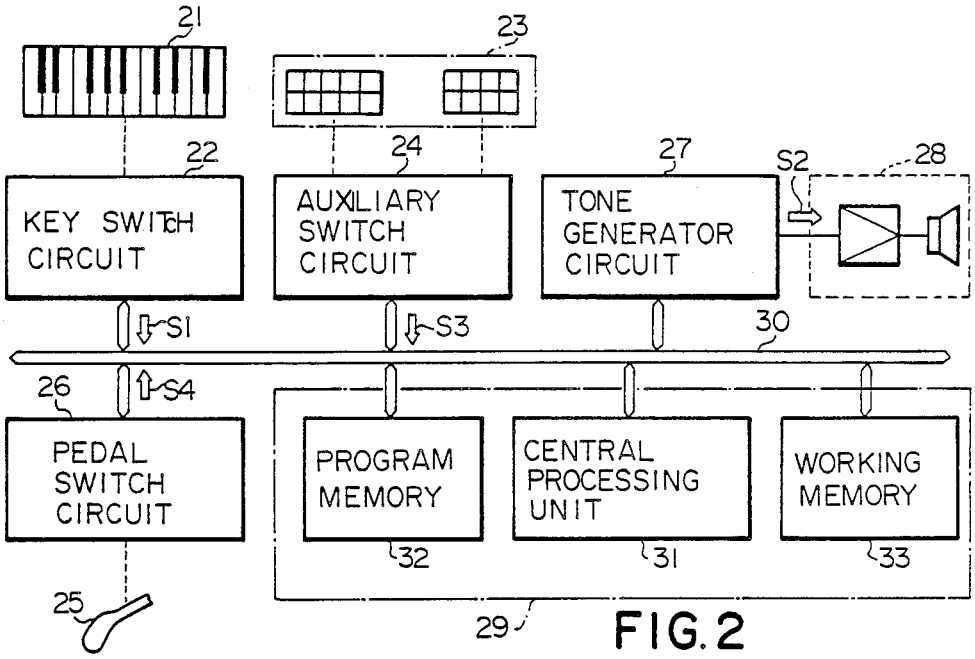
FIG. 2 is a block diagram showing the structure of an electronic percussion-type musical instrument embodying the present invention.

Referring now to FIG. 2 of the drawings, there is shown the structure of an electronic percussion-type musical instrument which largely comprises a keyboard 21 with a plurality of keys associated with a key switch circuit 22 operative to detect a key depressed or released by an player (which are hereinunder referred to as "key depression" and "key releasement"), a group of selecting switchs 23 associated with an auxiliary switch circuit 24 operative to detect a switch operated by the player for selection of, for example, a timbre, a grade of intensity, a tone-sustaining pedal 25 provided below the keyboard 21 so as to be actuated by a footstep of the player and associated with a pedal switch circuit 26 operative to detect the actuation of the tone-sustaining pedal 25, a tone generator circuit 27 operative to produce a tone signal which is supplied to a sound unit 23 for generating a tone on the basis of the tone signal, and a computer unit 29.

In this instance, the keyboard 21 and the key switch circuit 22 as a whole constitutes the keyboard unit 1, and the tone-sustaining pedal 25 and the pedal switch circuit 26 form in combination the sound-sustaining switch 4. Similarly, the tone-generator circuit 27 and the sound unit 28 as a whole constitute the sound generator means 9.

Each of the keys shifts its position from an undepressed state to a depressed state when the player depresses the key CR, and the key switch circuit 22 detects the depression of the key CR to produce a key state signal S1 representative of the depressed state and a key code KC(CR) assigned to the depressed key CR. The key code KC(CR) is finally supplied to the tone generator circuit 27, and the tone generator circuit 27 generates a tone signal S2 to cause the sound unit 28 to produce a tone with a note specified by the key code KC(CR). If the player releases the key CR after shifting into the depressed state, the key CR is moved in the opposite direction. Then, the key switch circuit 22 changes the key state signal S1 to indicate the undepressed state. On the other hand, some of the selecting switches 23 are selectively operated to assign a timbre to tones which will be produced by the sound unit 28, and another selecting switch is used for adjustment of the grade of intensity or the loudness of the tones. The operations of the selecting switches 23 are detected by the auxiliary switch circuit 24 to produce switch state signals S3 representative of a timbre data information, an information for the grade of intensity etc., however these components of the electronic percussion-type musical instrument may be per se similar to those of an ordinary electronic percussion-type musical instrument and, for this reason, no further description will be incorporated. The tone generator circuit incorporated in the electronic musical instrument illustrated in FIG. 2 has sixteen tone generating channels, and each of the tone generating channels produces a tone signal S2 on the basis of aforesaid key code, the timbre data information, the information for the grade of intensity etc. However, detailed description will also be omitted because of the well known structure in the art.

Figure 3:
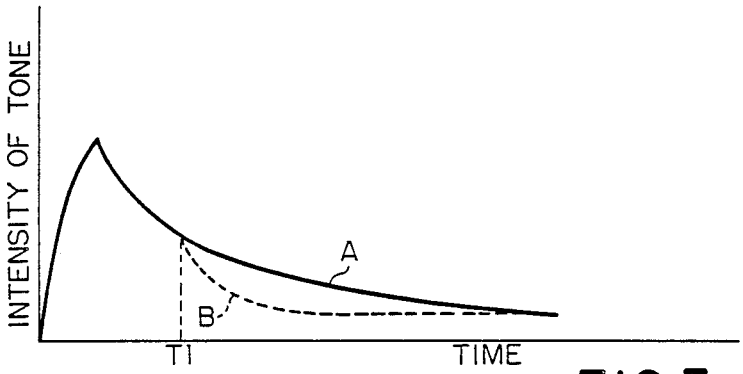
FIG. 3 is a graph showing the decay of a tone produced in the electronic percussion-type musical instrument illustrated in FIG. 2 in terms of time.

The tone-sustaining pedal 25 is actuated by the player when the player wants a tone to gradually decay along real line A in the graph shown in FIG. 3 after releasement of the key. Namely, when the player operates one of the switches assigned to the timbre of piano, the sound unit 28 is caused to tailor a wave shape of the tone represented by the real line A upon continuous depression of a key. Then, the tone has a relatively long decay time period. On the other hand, if the player releases the key without actuation of the tone-sustaining pedal 25 at time T1, the tone produced by the sound unit 28 rapidly decays along dash-lines B. Then, the tone has a relatively short decay time period. However, the player releases the key under actuation of the tone-sustaining pedal 25 at time T1, the intensity of tone traces the real line A as similar to the continuous depression of the key. As a result, the tone has a relatively long time period even if the key is released during the decay time period of the tone. Thus, the player can impart a tone-sustaining effect similar to the sostenuto effect provided by actuation of the sostenuto pedal of an acoustic piano to a tone generated by the sound unit 28. In this instance, the tone-sustaining pedal 25 is detected by the pedal switch circuit 26 to produce a pedal state signal S4 representative of the state of the tone-sustaining pedal 25.

The computer unit 29 is electrically coupled to the key switch circuit 22, the auxiliary switch circuit 24, the pedal switch circuit 26 and the tone generator circuit 27 through a multi-bit bus system 30. The computer unit 29 is provided with a central processing unit 31, a program memory 32 storing a series of instructions and a working memory 33 providing first to sixth temporary data storages 35, 36, 37, 38, 39 and 40, and the temporary data storages 35 to 40 are used for storing various kinds of data informations which will be hereinunder described in detail with reference to FIGS. 4A to 4F.

Namely, the first temporary data storage 35 has sixteen memory channels or registers corresponding to the sixteen tone generating channels of the tone generator circuit 27, respectively, and each of the registers is available to store a key code KC(i) supplied from the key switch circuit 22. Thus, the first temporary data storage 34 is capable of storing a maximum of sixteen key codes KC(0) to KC(15), and the key codes KC(i) stored therein are supplied in succession to the corresponding tone generating channels incorporated in the tone generating circuit 27, respectively. The second temporary data storage 36 also has sixteen memory channels or registers corresponding to the sixteen registers of the first temporary data storage 35, and, accordingly, to the tone generating channels, respectively, and each of the sixteen registers of the second temporary data storage 36 is used for storing a key-on flag information KON(i). The key-on flag information is shifted from a logic "0" state to a logic "1" state when the player depresses the key represented by the key code KC(i) stored in the corresponding register of the first temporary data storage 35. On the other hand, when the player releases the key, the key-on flag information is changed from the logic "1" state to the logic "0" state. Then, the second temporary data storage 36 is capable of preserving the sixteen key-on flag informations KON(1) to KON(15) of either logic "1" state or logic "0" state so as to show whether or not the keys represented by the key codes KC(i) in the first temporary data storage 35 are to be depressed by the player. Similarly, the third temporary data storage 37 has sixteen memory channels or registers corresponding to the sixteen registers of the first temporary data storage 35 and, accordingly, the sixteen tone generating channels, respectively, and each of the registers of the third temporary data storage 37 preserves a tone-sustaining flag information SON(i) of either logic "0" state or logic "1" state. In the tone-sustaining flag information SON(i), the logic "1" state represents the actuation of the tone-sustaining pedal 25, and, on the other hand, the logic "0" state indicates an inactive state of the tone-sustaining pedal 25. As described above, the registers of the third temporary data storage 37 is related to the registers of the first temporary data storage 35, respectively, so that the tone-sustaining flag information SON(i) of the logic "1" state stored in one of the registers represents that the tone-sustaining pedal is actuated by the player during the key depression represented by the key code KC stored in the corresponding register. Thus, the third temporary data storage 37 is capable of preserving the sixteen tone-sustaining data informations SON(0) to SON(15) of either logic "0" state or logic "1" state so as to show whether or not the tone-sustaining pedal 25 is actuated upon depressions of the respective keys represented by the key codes KC(i) stored in the corresponding registers of the first temporary data storage 35, respectively, and the tone-sustaining data informations SON(i) are respectively supplied to the tone generating channels of the tone generator circuit 27 in the form of control bit or bits so as to impart the tone-sustaining effect to the respective tones produced on the basis of the respective tone signals formed by the tone generating channels, respectively. The fourth temporary data storage 38 is used for storing sixteen key-off count data informations KOFCNT(0) to KOFCNT(15), and, for this reason, the fourth temporary data storage 38 is provided with sixteen memory channels or registers corresponding to the sixteen registers of the first temporary data storage 35, respectively. The key-off count data information KOFCNT(i) has a variable number increased from the releasement of the key represented by the key code KC(i) stored in the register of the first temporary data storage 35. For example, if one key-off count data information KOFCNT(i) has the largest number of all, the key represented by the key code KC(i) in the corresponding register of the first temporary data storage 35 was released first of all. On the contrary, if the key-off count data information KOFCNT(i) has the smallest number of all, the key represented by the key code KC in the corresponding register of the first temporary data storage 35 was finally released by the player. With the sixteen key-off count data informations KOFCNT(0) to KOFCNT(15) stored in the fourth temporary data storage 38, it is possible to fix the order of the key releasements and, accordingly, the order of terminations of the tones. Thus, each of the registers of the first temporary data storage 35 corresponds to the respective registers of the second, third and fourth temporary data storages 36 to 38, so that the data informations and the flag informations corresponding to one another are appended with (i)s such as the key code KC(i), the key-on data flag information KON(i), the tone-sustaining flag information SON(i) and the key-off count data information KOFCNT(i). When the data informations and the flag informations are appended with another letter or letters, the data informations and the flag informations are also related to one another.

The fifth temporary data storage 39 is provided with first, second, third and fourth registers 41, 42, 43 and 44 which store different data informations, respectively. In detail, the first register 41 stores an event key-code data information EVKC, and the event key-code data information EVKC has a binary number identical with the key code KC(CR) representing a key CR newly depressed. The second, third and fourth registers 42, 43 and 44 are provided to preserve a maximum key-off count data information MAX, a repeat data information SAME and an idle channel data information ASSCH, respectively. The maximum key-off count data information MAX is used to specify the register of the fourth temporary data storage 38 where the key-off count data information with the largest value is stored, and the repeat data information SAME identifies the register of the first temporary data storage 35 storing the key code KC(CR) identical with the event key-code data information EVKC. Finally, the idle channel data information ASSCH is used for specifying the tone generating channel in idle state, so that a set of data informations and flag informations will be stored in the registers related to the tone generating channel identified by the idle channel data information ASSCH. The sixth temporary data storage 40 is provided with a plurality of memory channels or registers for storing a set of key event data informations KSW, a pedal state data information SPSW and other data informations TSW including the timbre data information, the information for the grade of intensity and so on, all entered from the selecting switches 23. The key event data informations KSW are paired with the keys of the keyboard 21, respectively, and each of the key event data informations shows the key state such as the depressed state or the undepressed state. Similarly, the pedal state data information SPSW is used to show that the tone-sustaining pedal 25 is in the inactive state or the actuated state. The data informations TSW are related to the attribute of the tone such as, for example, the timbre and the intensity, however no further description is incorporated because of ordinal function of the percussion-type musical instrument.

In this instance, the first and second temporary data storages 35 and 36 as a whole constitute the first memory means 2, and the third temporary data storage 37 forms the second memory means 6. A part of the sixth temporary data storage 40 preserving the key event data information KSW provides the third memory means and another part of the sixth temporary data storage 40 preserving the pedal state data information SPSW forms the fourth memory means. On the other hand, the fourth temporary data storage 38 provides the fifth memory means.

Figure 5:
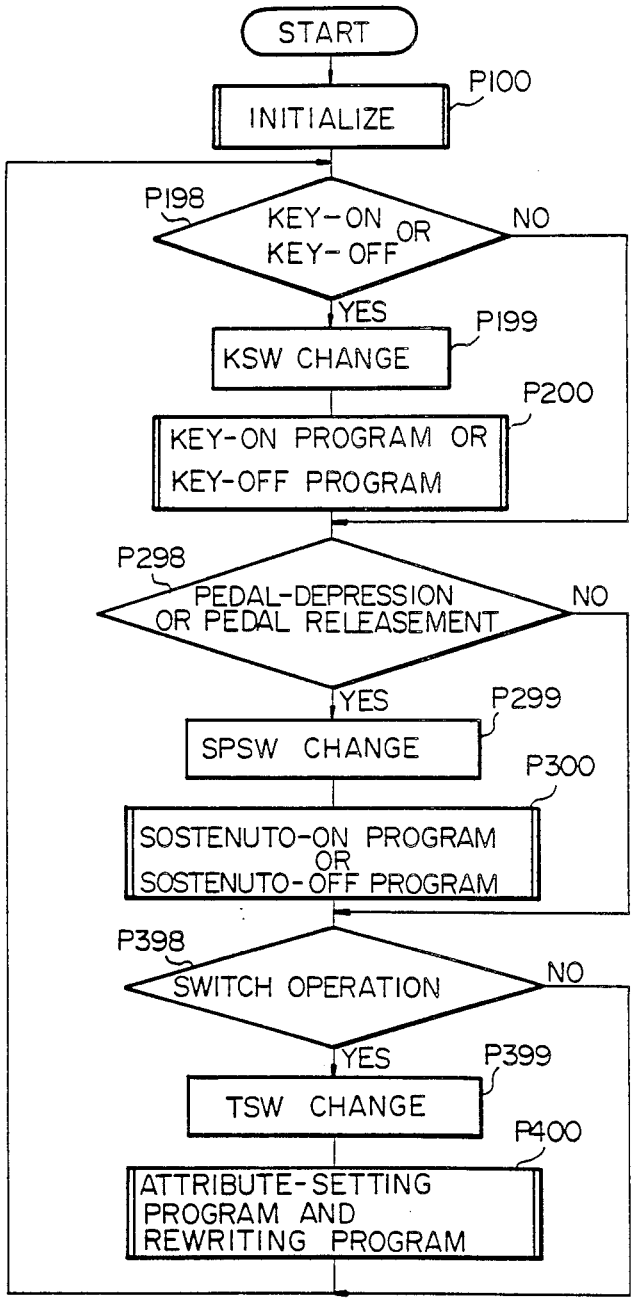
FIG. 5 is a flowchart showing the main routine program executed by the central processing unit incorporated in the electronic musical instrument shown in FIG. 3.

Description is hereinunder made for the operation of the musical instrument illustrated in FIG. 2 with reference to FIG. 5. FIG. 5 shows the flowchart of a main routine program effective to execute the general algorithm of the control scheme to be implemented by means of the computer unit 29 incorporated in the electronic musical instrument embodying the present invention.

Main Routine Program

Figure 8:
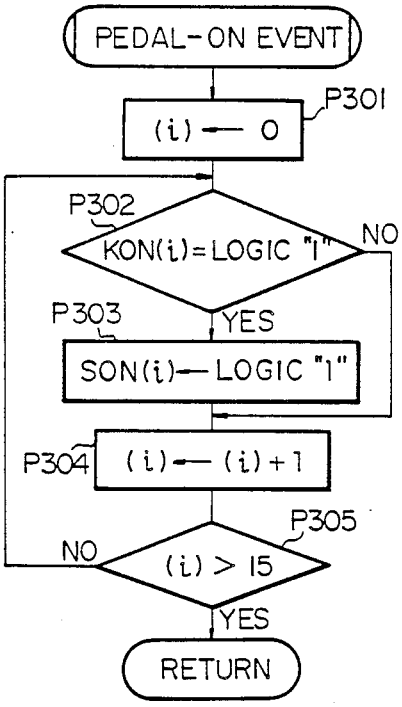
FIG. 8 is a flowchart showing the sosutenuto-on program executed by the central processing unit upon actuation of the tone-sustaining pedal.
Figure 9:
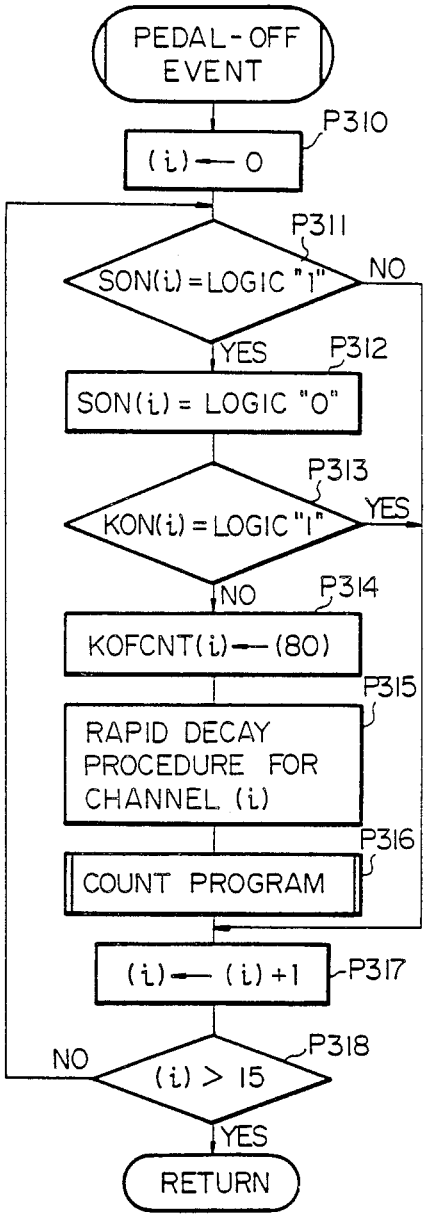
FIG. 9 is a flowchart showing the sosutenuto-off program executed by the central processing unit upon inactivation of the tone-sustaining pedal.

When a power supply switch (not shown) is depressed and turned on, the computer unit 29 starts operation and first executes an initializing program as by step P100 to set all of the variable data informations in the computer unit 29 to the starting values. Then, all of the registers in the working memory 33 are cleared to set the data informations to initial values, respectively. The central processing unit 31 then checks into the key switch circuit 22 to see if a key of the keyboard 21 is depressed or released by the player by comparing the key state information represented by the key state signal S1 produced by the key switch circuit 22 with the key event data information KSW stored in the sixth temporary data storage 35 as by step P198. If there is a key CR depressed or released by the player, the central processing unit 31 detects a key-on event or a key-off event and changes the key event data information KSW(CR) of the depressed key CR as by step P199. The central processing unit 31 further executes a key-on program shown in FIG. 6 or a key-off program shown in FIG. 7 as by step P200. If there is no key depressed or released by the player, the central processing unit 31 proceeds to step P298 without executing the key-on program and the key-off program. When the execution of the key-on program or the key-off program is completed, the central processing unit 31 also proceeds to the step P298 to check into the pedal switch circuit 26 to see if the tone-sustaining pedal 25 is actuated by the player by comparing the state of the tone-sustaining pedal represented by the pedal state signal S4 produced by the pedal switch circuit 26 with the pedal state data information SPSW stored in the sixth temporary data storage 40. If the tone-sustaining pedal 25 is actuated, a pedal-on event is detected by the central processing unit 31 and the central processing unit 31 changes the pedal state data information SPSW as by step P299. The central processing unit 31 further execute a sostenuto-on program shown in FIG. 8 as by step P300. Similarly, when the tone-sustaining pedal 25 is released by the player, a pedal-off event is detected by the central processing unit 31, and the central processing unit 31 changes the pedal state data information SPSW as by the step P299. The central processing unit 31 further executes a sostenuto-off program shown in FIG. 9 by step P300. If both of the pedal-on event and the pedal-off event are not detected by the central processing unit 31, the central processing unit 31 proceeds to step P398 without executing the sostenuto-on program and the sostenuto-off program. Similarly, after execution of the sostenuto-on program or the sostenuto-off program, the central processing unit 31 proceeds to the step P398 to check into the auxiliary switch circuit 24 to see if one of the selecting switches 23 is operated by the player by comparing the data information represented by the switch state signals S3 supplied from the auxiliary switch circuit 24 with the data information TSW stored in the sixth temporary data storage 40. If one of the selecting switches 23 is operated by the player, the central processing unit 31 detects the switch-operation event and changes the data informations TSW in accordance with the selecting switch operated by the player as by step P399. The central processing unit further executes an attribute-setting program to supply the tone generator circuit 27 with a control data information corresponding to the selecting switch operated by the player. The central processing unit 31 further executes a rewriting-program to change the data information TSW so as to indicate the attribute set by the attribute-setting program as by step P400. If no switch-operation event is detected by the central processing unit 31, the central processing unit 31 returns to the step P198 without execution of the attribute-setting program and the rewriting program to check into the key switch circuit 22. When the executions of the attribute-setting program and the rewriting program are completed, the central processing unit 31 also returns to the step P198. Thus, the central processing unit 31 reiterates the loop consisting of steps 198, 199, 200, 298, 299, 300, 398, 399 and 400 during a performance of the electronic musical instrument to produce a fine melody reflecting the player's intention.

Now, description will be made in detail for fresh key-on and fresh key-off events, pedal-on and pedal-off events and a repeated key-on state, respectively. In the following description, a pointer value (i) or (j) is frequently used to identify a certain data information such as, for example, a key-on data information KON(i), a tone-sustaining data information SON(i) or a key-off count data information KOFCNT(i). If the pointer value (i) is appended to different data informations referred to in a single execution of a loop consisting of a plurality steps, these different data informations are related to one another or supplied to a certain tone generating channel (i) for generating a tone specified by the key depression. However, if the pointer value (i) is incremented, a data information appended with (i) such as a key-on flag information KON(i) means a data information (i+1), or a key-on data information (i+1) with respect to the former data information (i) appearing in the previous execution of the loop.

Fresh Key-on Event

When the player depresses a key CR to which no tone generating channel has been assigned, the central processing unit 31 detects the fresh key-on event and, thereafter, detects the fresh key-off event upon releasement of the key CR.

Figure 6A:
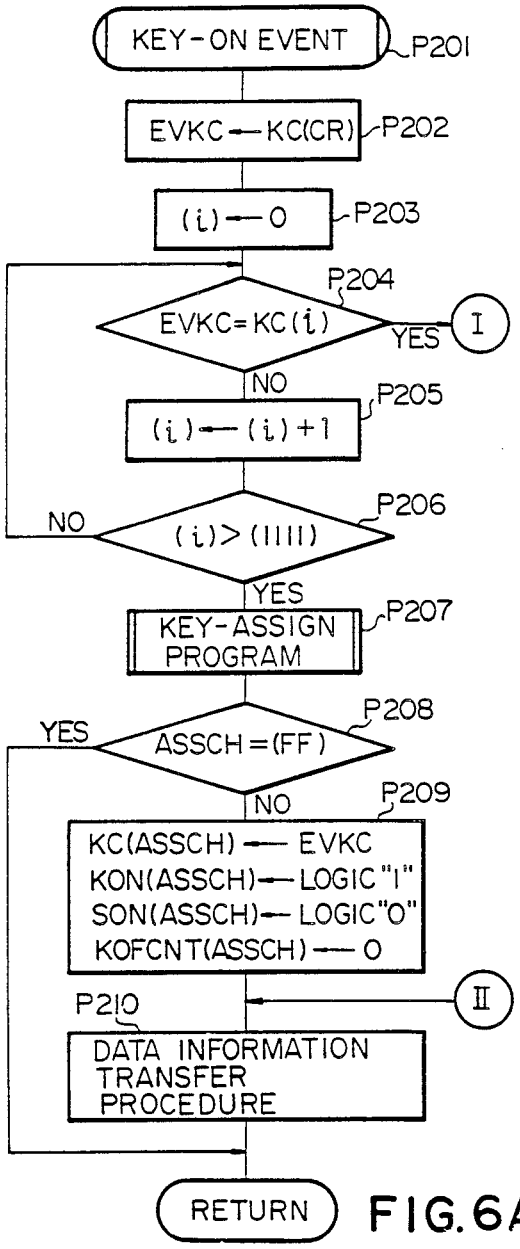
FIGS. 6A and 6B are flowcharts showing the key-on program executed by the central processing unit upon detection of a key depression.
Figure 6B:
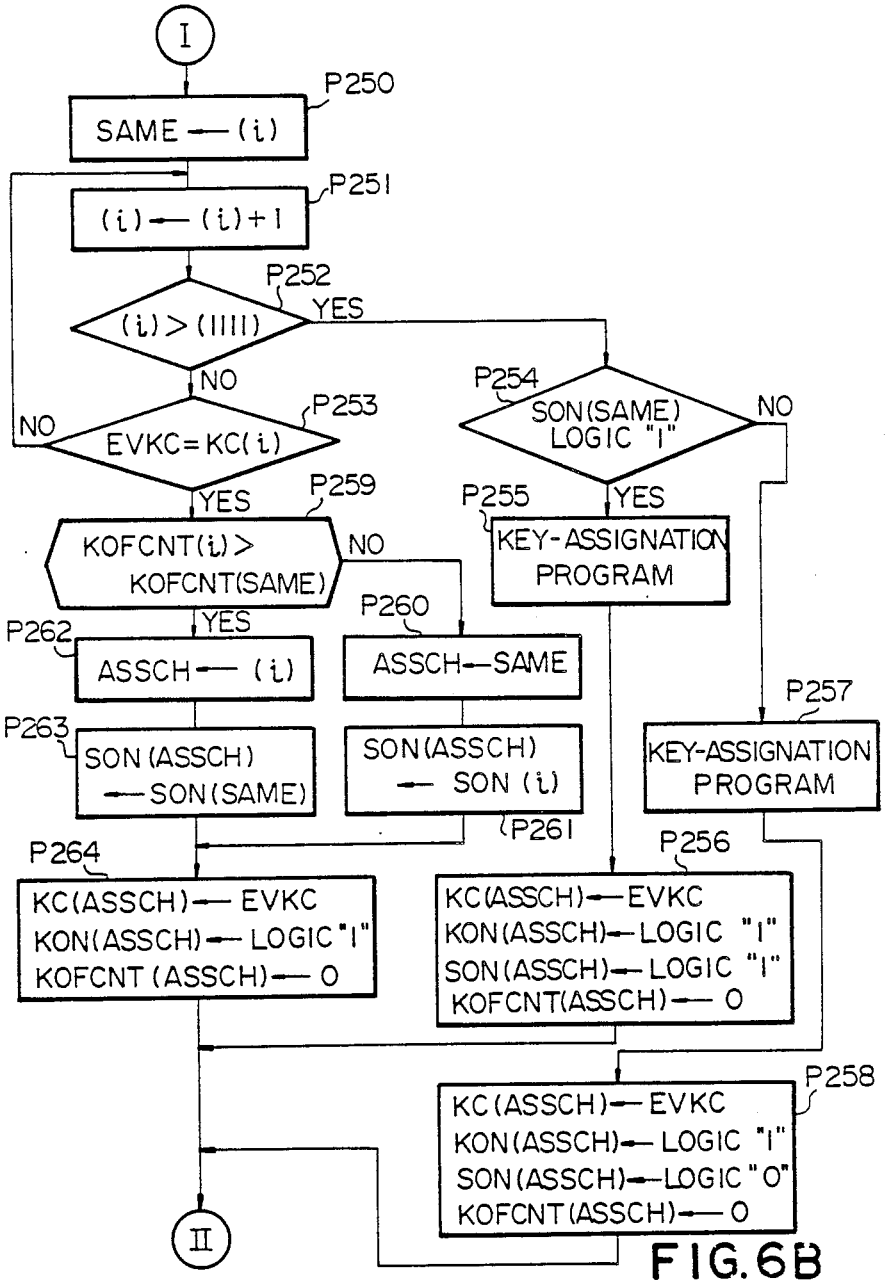

As described hereinbefore, if the central processing unit 31 detects the key-on event, the central processing unit 31 executes the key-on program shown in FIGS. 6A and 6B. Namely, with the key-on event, the central processing unit 31 starts the execution of the key-on program as by step P201 and latches the key code KC(CR) representing the depressed key CR to one of the internal registers thereof. Then, the central processing unit 31 changes the key event data information EVKC stored in the first register 41 of the fifth temporary data storage 39 to a binary number identical with the key code KC(CR) as by step P202. Namely, the central processing unit sends a write-in request with the address information AD(1) indicating the first register 41 followed by the key code KC(CR) to the working memory 33. Subsequently, the central processing unit 31 sets a pointer thereof (not shown) to an initial pointer value (i) of zero for use in producing an address information AD1(0) indicating the register where the key code KC(0) is stored as by step P203. The central processing unit 31 sends a read-out request with the address information AD1(0) formed on the basis of the pointer value (i) of zero to the working memory 33, and, then, the key code KC(0) is transferred from the register to the central processing unit 31. It is thus questioned by decision step P204 whether or not the key event data information EVKC, or the key code KC(CR), is identical with the key code KC(0). If the answer in the decision step P204 is in the negative, the central processing unit 31 adds one to the pointer value (i), which is currently to be the binary number 0, to produce an address information AD1(i) indicating the register storing the subsequent key code as by step P205. The central processing unit 31 then decides as by decision step P206 whether or not the pointer value (i) is greater than binary number (1111). If it is found that the pointer value (i) is equal to or less than the binary number (1111), the central processing unit 31 returns to the decision step P204 to check into the first register 41 to see if the event key-code data information EVKC is identical with the subsequent key code KC(i). Upon a fresh key-on event, no tone generating channel is assigned to the key code KC(CR), so that the answer in the decision step P204 is in the negative at all times. Thus, the the central processing unit 31 reiterates the loop consisting of the steps P204 to P206 until the answer in the decision step P206 is in the positive. If it is found in the decision step P206 that the pointer value (i) is greater than the binary number (1111), the central processing unit 31 proceeds to step P207 to execute a key-assignation program shown in FIG. 10.

Figure 10:
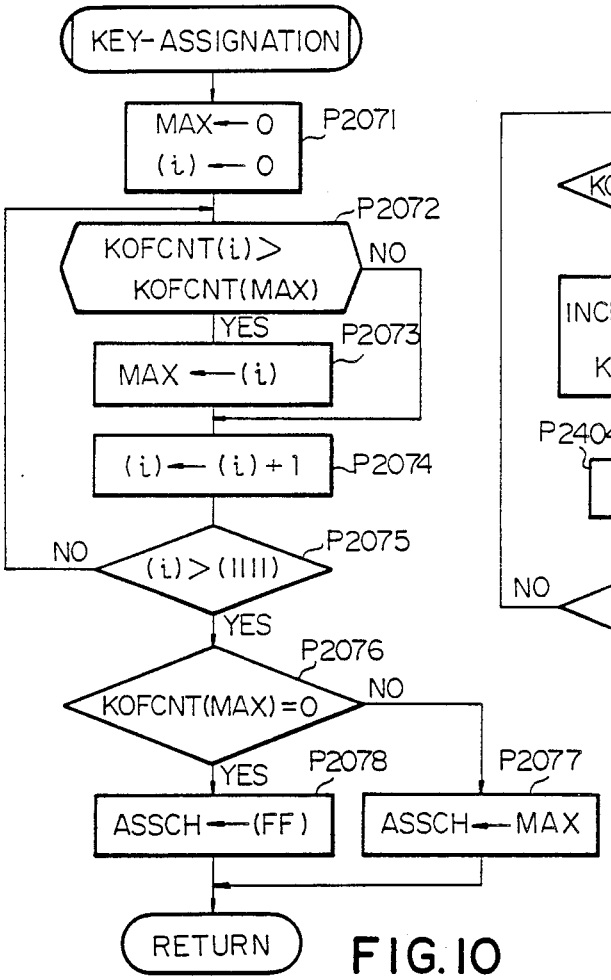
FIG. 10 is a flowchart showing the key-assignation program executed by the central processing unit in the key-on program.

Description is focused on the key-assignation program with reference to FIG. 10 of the drawings. In the key-assignation program, the central processing unit 31 firstly sets the second register 42 of the fifth temporary data storage 39 storing the maximum key-off count data information MAX to an initial value of zero. Moreover, the central processing unit 31 sets a pointer thereof (not shown) to an initial pointer value (i) of zero used for producing an address information AD4(0) indicating one of the registers of the fourth temporary data storage 38 storing the key-off count data information KOFCNT(0) as by step P2701. The central processing unit 31 sends a read-out request with the address information AD4(0) to the working memory 33, and the key-off count data information KOFCNT(0) is then transferred to the central processing unit 31 to see if the key-off count data information KOFCNT(0) is larger in value than a maximum key-off count data information KOFCNT(max) as by step P2072. In this stage, the central processing unit 31 assumes that the key-off count data information KOFCNT(0) is the maximum key-off count data information (max), so that the central processing unit 31 temporary stores the key-off count data information KOFCNT(0) in an internal register (not shown). The central processing unit 31 then proceeds to step P2074 to add one to the pointer value (i), which is zero in this stage. It is thus questioned by step P2075 whether or not the pointer value (i) is greater than the binary number (1111). If it is determined that the pointer value (i) is not greater than the binary number (1111), the central processing unit 31 returns to the step P2072 to form a new address information AD4(i) on the basis of the pointer value (i) so as to access the subsequent key-off count data information KOFCNT(i). The central processing unit 31 then sends a read-out request with the address information AD4(i) to the working memory 33, and the subsequent key-off count data information KOFCNT(i) is transferred to the central processing unit 31. The subsequent key-off count data information KOFCNT(i) thus read out is compared with the maximum key-off count data information KOFCNT(max) temporary stored in the internal register, which is identical with the key-off count data information KOFCNT(0) in this stage, to see if the key-off count data information KOFCNT(i) is greater than the maximum key-off count data information KOFCNT(max). If it is decided by the step P2072 that the key-off count data information KOFCNT(i) is greater in value than the maximum key-off count data information KOFCNT(max), the central processing unit 31 writes the pointer value (i) into the second register 42 of the fifth temporary data storage 39 storing the maximum key-off count data information MAX as by step P2073. The central processing unit 31 further writes the key-off count data information KOFCNT(i) in the internal register thereof as the maximum key-off count data information KOFCNT(max) for use in the subsequent comparison procedure. After the write-in operations, the central processing unit 31 proceeds to the step P2074 to add one to the pointer value (i) which is available to produce a new address information AD4(i) used for access to the subsequent key-off count data information KOFCNT(i). In this manner, the central processing unit 31 reiterates the loop consisting of the steps P2072 to P2075 to search the fourth temporary data storage 38 for the maximum key-off count data information KOFCNT(max). If it is found by the decision step P2075 that the pointer value (i) is greater than the binary number (1111), the maximum key-off count data information MAX is left in the second register 42 of the fifth temporary data storage 39, so that the central processing unit 31 proceeds to step P2076 to see whether or not the maximum key-off count data information MAX has a value equal to zero. If the answer in the decision step P2076 is in the negative, the central processing unit 31 writes the maximum key-off count data information MAX into the fourth register 44 of the fifth temporary data storage 39 storing the idle channel data information ASSCH as by step P2077. On the other hand, the answer in the decision step P2076 is in the positive, the central processing unit 31 writes hexadecimal number (FF) into the fourth register 44 storing the idle channel data information ASSCH as by step P2078. In this instance, the hexadecimal number (FF) is used for indicating that all of the tone generating channels are assigned to sixteen keys each currently in the depressed state, however another hexadecimal number except for hexadecimal numbers (00) to (0E) may be used to indicate the busy state of all tone generating channels.

After the execution of the step P2077 or P2078, the central processing unit 31 returns to the key-on program and proceeds step P208 to decides whether or not the idle channel data information ASSCH is to be the hexadecimal number (FF). In other words, the central processing unit 31 checks into the fourth register 44 storing the idle channel data information ASSCH to see if there is any tone generating channel to be assigned to the key CR newly depressed by the player. If the answer in the decision step P208 is in the negative, the central processing unit 31 writes the key code KC(CR) into a register of the first temporary data storage 35 related to the tone generating channel specified by the idle channel data information ASSCH. Thus, the register designated by the idle channel data information ASSCH stores the key code KC(ASSCH) identical with the key code KC(CR) representing the newly depressed key CR. The central processing unit 31 further changes the respective related registers of the second, third and fourth temporary data storages 36, 37 and 38 in the logic "1" state, the logic "0" state and binary number of zero, respectively, as by step P209. Then, the related registers of the second, third and fourth temporary data storages 36, 37 and 38 retain the key-on flag information KON(ASSCH) of the logic "1" state, the tone-sustaining flag information SON(ASSCH) of the logic "0" state and the key-off count data information KOFCNT(ASSCH) of zero, respectively. The step P209 is followed by step P210 in which the central processing unit 31 transfers the key code KC(ASSCH), and all of the control data informations necessary to produce a tone signal from the working memory 33 to the tone generating channel designated by the idle channel data information ASSCH. One of the data informations supplied to the tone generating channel is called a decay time period control data information, and the decay time period control data information is set to the logic "1" state so as to impart the relatively long decay time period as indicated by real line A in FIG. 3 to the tone when at least one of the key-on data information KON(ASSCH) and the tone-sustaining flag information SON(ASSCH) is to be the logic "1" state. After the step P210, the central processing unit 31 returns to the main routine program shown in FIG. 5 and proceeds to the step P299. If the answer in the step P208 is in the positive, the central processing unit 31 returns to the main routine program without the executions of the steps 209 and 210. This means that the central processing unit does not assign any tone generating channel to the key code KC(CR), thereby ignoring the key depression.

Fresh Key-off Event

Figure 7:
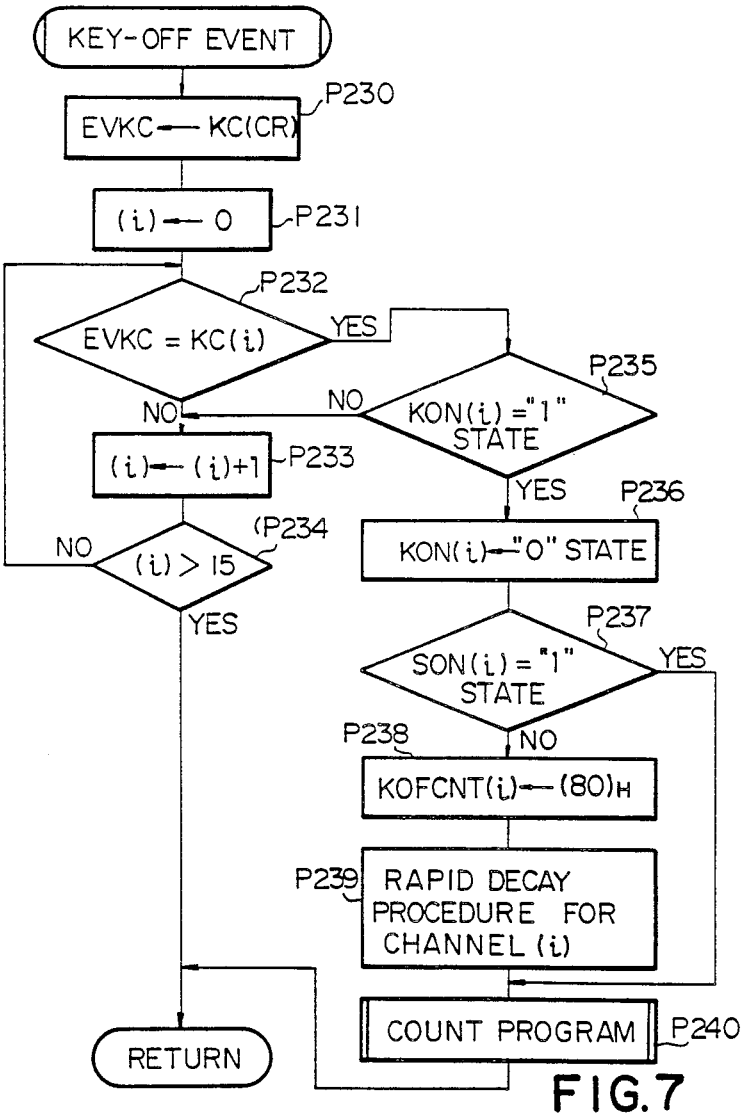
FIG. 7 is a flowchart showing the key-off program executed by the central processing unit upon detection of a key releasement.

Upon releasement of the key, the key-off event is detected by the central processing unit 31 as by the step P198, and the central processing unit 31 executes the key-off program shown in FIG. 7. Namely, the central processing unit 31 writes the key code KC(CR) of the released key CR into the first register 41 for the event key-code data information EVKC as by step P230 and proceeds to step P231. In the step P231, the central processing unit 31 sets an initial pointer value of zero into a pointer thereof (not shown), then forming an address information AD1(0) indicating the register of the first temporary data storage 35 so as to access the key code KC(0) stored therein. When a read-out request with the address information AD1(0) is sent to the working memory 33, the key code KC(0) is read out from the register specified by the address information AD1(0) and transferred to the central processing unit 31. With the key code KC(0) read out from the first temporary data storage 35, it is questioned by step P232 whether or not the key code KC(0) is equal in binary number to the event key-code data information EVKC. If the answer in the step P232 is in the negative, the central processing unit 31 adds one to the pointer value (i) stored in the pointer thereof as by step P233. After the step P233, the central processing unit 31 checks into the pointer to see if the pointer value (i) is greater than the binary number (1111). If it is determined by the decision step P234 that the pointer value (i) is not greater than the binary number (1111), the central processing unit 31 returns to the decision step P232 to see if the subsequent event key-code data information EVKC is identical with the subsequent key code KC(i). Thus, the central processing unit 31 reiterates the loop consisting of the steps P232 to P234 until the answer in the decision step P232 is in the positive. If it is found in the decision step P232 that the event key-code data information EVKC is identical with the key code KC(i), the central processing unit 31 proceeds to step P235 to see if the key has been in the depressed state. Namely, the central processing unit 31 produce an address information AD2(i) on the basis of the pointer value (i) to access the key-on data information KON(i) stored in the register of the second temporary data storage 36, and a read-out request with the address information AD2(i) is supplied to the working memory 33. The key-on data information KON(i) is transferred to the central processing unit 31 and tested to see if the key-on data information KON(i) is to be the logic "1" state. The fresh key-off event follows the fresh key-on event, so that the central processing unit 31 decides in the decision step P235 that the key-on data information KON(i) is in the logic "1" state. After confirmation procedure in the step P235, the central processing unit 31 proceeds to step P236 and changes the key-on data information from the logic "1" state to the logic "0" state. The central processing unit 31 then produces an address information AD3(i) on the basis of the pointer value (i) to access the tone-sustaining flag information SON(i) stored in the register of the third temporary data storage 37, and sends a read-out request with the address information AD3(i) to the working memory 33. The tone-sustaining flag information SON(i) is then transferred from the working memory 33 to the central processing unit 31, and the central processing unit 31 decides whether or not the tone-sustaining flag information SON(i) is in the logic "1" state as by step P237. If the tone-sustaining pedal 25 was not actuated, the tone-sustaining flag information SON(i) is in the logic "0" state, so that the answer in the decision step P237 is in the negative. With the negative answer, the central processing unit 31 proceeds to step P238 in which the central processing unit 31 sets hexadecimal number (80) into the register of the fourth temporary data storage 38 storing the key-off count data information KOFCNT(i). The central processing unit 31 proceeds to step P239 and executes a rapid decay procedure. Namely, the central processing unit 31 forms the control data information requesting the tone generating channel to rapidly decay the tone on the basis of the key-on flag information KON(i) of the logic "0" and the tone-sustaining flag information SON(i) of the logic "0" state. With the control data information for rapid decay, the tone generating channel causes the sound unit 28 to rapidly decrease the tone intensity along the dash-lines B shown in FIG. 3 of the drawings. Subsequently, the central processing unit 31 starts the execution of a count program as by step P240 illustrated in FIG. 11. If it is found by the decision step P237 that the tone-sustaining pedal 25 has been actuated by the player, the central processing unit 31 immediately starts the execution of the count program.

In the count program P240, the central processing unit 31 set an initial pointer value (j) of zero into a pointer thereof (not shown) as by step P2401. The central processing unit 31 then proceeds to step P2402 to see if the key-on flag information KON(j) is in the logic "0" state. Namely, the central processing unit 31 produces an address information AD2(j) used to access the key-on flag information KON(j) and sends a read-out request with the address information AD2(j) to the working memory 33. Then, the key-on flag information KON(j) is transferred from the working memory 33 to the central processing unit 31, and the central processing unit 31 determines whether or not the key-on flag information KON(j) is in the logic "0" state. If it is found that the key-on data information KON(j) is in the logic "0" state, the central processing unit 31 proceeds to step P2403 to increment the key-off count data information KOFCNT(j) related to the key-on data information KON(j) representing the undepressed state. After incrementation of the key-off count data information KOFCNT(j), the central processing unit 31 proceeds to step P2404, however if the answer in the decision step P2402 is in the negative, the central processing unit 31 directly proceeds to the step P2404 without execution of the step P2403. In the step P2404, the central processing unit 31 adds one to the pointer value (j), and decides whether or not the pointer value (j) is greater than binary number (1111) as by step P2405. If it is found that the pointer value (j) is not greater than the binary number (1111), the central processing unit 31 returns to the step P2402. Thus, the central processing unit 31 reiterates the loop consisting of the step P2402 to P2405 until the answer in the decision step P2405 is in the positive so as to increment the respective key-off count data informations related to the keys in the undepressed states, respectively. This procedure allows the fourth temporary data storage 38 to retain the maximum binary number in the register related to the tone generating channel which has been in the idle state for the longest time period. This results in that the central processing unit 31 can assign the tone generating channel in the longest idle state to a key CR newly depressed by the player in the key-assignation program. Additionally, the key-off count data information KOFCNT has been changed to the hexadecimal number (80) if the tone-sustaining data information SON related thereto is in the logic "0" state, so that there is no key-off count data information KOFCNT to have the maximum binary number in so far as the tone-sustaining data information SON related thereto is in the logic "1" level. For this reason, the central processing unit 31 does not assign the tone generating channel with the control data information for the tone-sustaining effect to a key newly depressed by the player. Turning back to the flowchart for the count program, when the pointer value (j) is increased to binary number (10000), the central processing unit 31 finds that the all of the key-on data informations KON(0) to KON(15) have been tested, then the answer in the decision step P2405 is in the positive. With the positive answer in the decision step P2405, the central processing unit 31 returns to the key-off program shown in FIG. 7 and subsequently returns to the main routine program shown in FIG. 5 of the drawings. In the case where no register of the first temporary data storage 35 stores the key code identical with the event key-code data information EVKC, the central processing unit 31 can not proceeds the step P235 because of the successive negative answers in the decision step P232. As a result, the central processing unit 31 returns to the main routine program without execution of the rapid decay procedure. However, the above case is caused by no assignation of the tone-generating channel in the step P208, so that no problem takes place in the electronic musical instrument due to the direct termination of key-off program.

Pedal-On Event

Description is made for the pedal-on event on the assumption that a key CR has been depressed by the player. When the central processing unit 31 reiterates the loop consisting of the steps P198 to P400, the player actuates or depresses the tone-sustaining pedal 25. The central processing unit 31 detects the pedal-on event, so that the answer in the decision step P298 is in the positive, then the central processing unit 31 executes the sostenuto-on program shown in FIG. 8. Namely, the central processing unit 31 sets an initial pointer value of zero into a pointer thereof (not shown) as by step P301. After initialization of the pointer, the central processing unit 31 produces an address information AD1(i) on the basis of the pointer value (i) so as to access the key-on flag information KON(i) stored in the register of the second temporary data storage 36, then sending a read-out request with the address information AD(i) to the working memory 33. The key-on data information KON(i) is transferred from the working memory 33 to the central processing unit 31, and the central processing unit 31 decides as by step P302 whether or not the key-on data information KON(i) is in the logic "1" state. If it is found by the decision step P302 that the key-on flag information KON(i) is in the logic "0" state, the central processing unit proceeds to step P304 and adds one to the pointer value (i) for incrementation. Upon completion of the calculation, it is questioned by step P305 whether or not the pointer value (i) is greater than binary value (1111). If it is found that the pointer value (i) is not greater than the binary value (1111), the central processing unit 31 returns to the step P302 to see if the subsequent key-on data information KON(i) is in the logic "1" state. In this way, the central processing unit 31 reiterates the loop consisting of the steps P302, P304 and P305 to search the second temporary data storage 35 for the key-on flag information KON(i) of the logic "1" state. If it is found that a key-on flag information KON(i) is in the logic "1" state, the central processing unit 31 produces an address information AD3(i) on the basis of the pointer value (i) so as to specify the register storing the tone-sustaining flag information SON(i) related to the key-on data information KON(i) of the logic "1" state. After a write-in request with the address information AD3(i), the central processing unit 31 transfers a data information to shift the tone-sustaining data information SON(i) from the logic "0" state to the logic "1" state as by step P303 followed by the step P304. When the tone-sustaining data information SON(i) is shifted to the logic "1" state, the tone generating channel is caused to produce a tone signal to make a request for imparting the tone-sustaining effect, thereby allowing the tone intensity to gradually decay along the real line A in FIG. 3 even if the key CR has been released in the decay time period. Thus, the central processing unit 31 is responsive to the actuation of the tone-sustaining pedal 25 and set the the logic "1" state to the tone-sustaining flag information SON(i) stored in the register of the third temporary data storage 37 related to the tone generating channel assigned to the depressed key CR upon actuation of the tone-sustaining pedal 25. This means that the player can impart the tone sustaining effect to the tone by the tone-sustaining pedal 25. When the central processing unit 31 completes a task of checking all of the key-on flag informations KON(0) to KON(15), the answer in the decision step 305 is in the positive, so that the central processing unit 31 returns to the main routine program.

Pedal-Off Event

When the player releases the tone-sustaining pedal 25 for inactivation. The central processing unit 31 detects the pedal-off event and, then, executes the sostenuto-off program shown in FIG. 9. First, the central processing unit 31 clears the pointer thereof to the initial pointer value (i) of zero as by step P310. The central processing unit 31 produces an address information AD3(i) on the basis of the pointer value (i) to access the tone-sustaining flag information SON(i) stored in the third temporary data storage 37, thereby sending a read-out request with the address information AD3(i) to the working memory 33. With the read-out request, the tone-sustaining flag information SON(i) is transferred from the working memory 33 to the central processing unit 31, so that the central processing unit 31 determines whether or not the tone-sustaining flag information SON(i) read out from the third temporary data storage 37 is in the logic "1" state as by step P311. If it is found that the tone-sustaining flag information SON(i) is in the logic "0" state, the central processing unit 31 proceeds to step P317, and the pointer value (i) is incremented by one. After increment of the pointer value (i), the central processing unit 31 checks the pointer to see if the pointer value (i) is greater than the binary number (1111) as by step P318. If it is found that the pointer value (i) is not greater than the binary number (1111), the central processing unit 31 returns to the step P311 to check the subsequent tone-sustaining flag information SON(i). In this way, the central processing unit 31 reiterates the loop consisting of the steps P311, P317 and P318 to search the third temporary data storage 37 for the tone-sustaining flag information of the logic "1" state. If it is found that the tone-sustaining flag information SON(i) is in the logic "1" state, the central processing unit 31 proceeds to step P312 in which the tone-sustaining flag information SON(i) is changed from the logic "1" state to the logic "0" state. In order to change the state of the tone-sustaining flag information SON(i), the central processing unit 31 produces an address information AD3(i) indicating the register of the third temporary data storage 37 storing the tone-sustaining data information SON(i) and, then, sends a write-in request with the address information AD3(i) followed by a data information indicating the logic "0" to the working memory 33. After changing operation on the tone-sustaining flag information SON(i) for the logic state, the central processing unit 31 decides whether or not the key-on flag information KON(i) is in the logic "1" state. If it is determined that the key-on flag information KON(i) is in the logic "1" state, the central processing unit 31 proceeds to the step P317 without execution of a series of steps P314, P315 and P316. On the other hand, if it is found that answer in the decision step P313 is in the negative, the central processing unit 31 produces an address AD4(i) information indicating the register of the fourth temporary data storage 38 storing the key-off count data information KOFCNT(i) and, thereafter, sends a write-in request with the address information AD4(i) followed by hexadecimal number (80) to the working memory 33 so as to rewrite the key-off count data information KOFCNT(i) is rewritten to the hexadecimal number (80), the central processing unit 31 executes the rapid decay procedure for the tone generating channel (i) as by the step P315.

Figure 11:
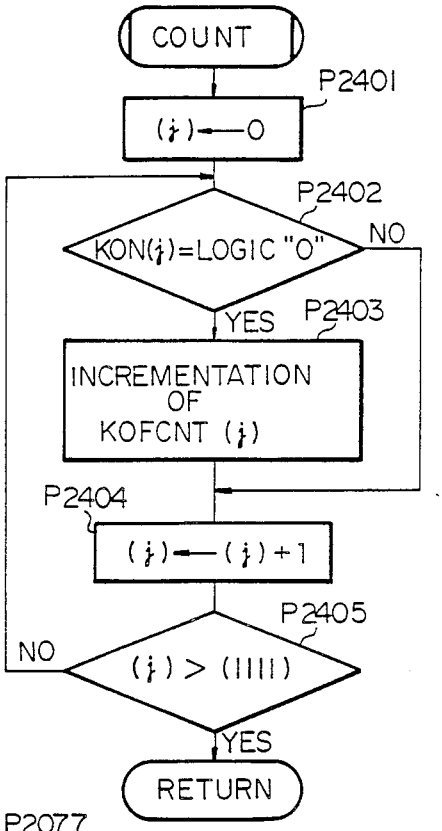
FIG. 11 is a flowchart showing the count program executed by the central processing unit in the key-off program and the sosutenuto-off program.

The rapid decay procedure is similar to that in the key-off program shown in FIG. 7, and no further description is incorporated for the sake of simplicity. After execution of the rapid decay procedure for the tone generating channel (i), the central processing unit 31 executes the count program consisting of the steps P2401 to P2405 as shown in FIG. 11 of the drawings for increasing the individual key-off count data informations KOFCNT(0) to KOFCNT(15), however detailed description is omitted for avoiding a repeat.

After execution of the count program, the central processing unit 31 returns to the sostenuto-off program and proceeds to the step P317 for increasing the pointer value (i). Thus, the central processing unit 31 reiterates the loop consisting of the steps P311 to P318 until the pointer value (i) is greater than the binary number (1111) so as to rapidly decay the tone currently produced in response to the pedal-off event. Finally, if it is detected by the step P318 that the pointer value (i) is greater than the binary value (1111), the central processing unit 31 returns to the main routine program shown in FIG. 5.

Repeated Key-on State

Description will be hereinunder made for the repeated key-on state with reference to FIG. 6B of the drawings. In the repeated key-on state, the player repeats a key depression, so that the key is moved from the undepressed state to the depressed state, returning from the depressed state to the underpressed state upon the key releasement, thereafter being moved from the undepressed state to the depressed state again, then returning from the depressed state to the undepressed state again.

During the central processing unit 31 executes the main routine program, if it is found that a key CR is depressed twice by the player, the central processing unit 31 executes the key-on program and, thereafter, the key-off program as similar to the fresh key-on event and the key-off event for the first key depression and the first key releasement, respectively. Then, the central processing unit 31 returns to the main routine program to detect the second key-on event. Upon detection of the second key-on event, the central processing unit 31 proceeds the key-on program and reiterates the loop consisting of the steps P204 to P206 so as to decide whether or not the first temporary data storage has a register storing the key code KC(i) identical with the event key-code data information EVKC. The key code KC(i) was stored in a certain register of the first temporary data storage 35 upon first key depression. For this reason, it is found by the step P204 that there is the key code KC(i) identical with the event key-code data information EVKC, so that the central processing unit sends the pointer value (i) to the fifth temporary data storage 39 so as to write the pointer value (i) into the third register 43 as the repeat data information SAME as by step 250. Subsequently, the pointer value (i) is incremented as by step P251 and is compared with binary number (1111) to see if the pointer value (i) is greater than the the binary number (1111) as by step P252. If it is found that the pointer value (i) is not greater than the binary number (1111), the central processing unit 31 proceeds to step P253 to determine whether or not the event key code data information EVKC is identical to another key code KC(i) stored in the first temporary data storage 35. If the key code KC(CR) is assigned to only one tone generating channel, the answer in the step P253 is in the negative until the pointer value (i) is incremented to binary number (10000). Then, the answer in the decision step P252 becomes to be in the positive, the central processing unit 31 proceeds to step P254 to determine whether or not the sound unit 28 terminates the tone production due to the first key releasement. Namely, the central processing unit 31 sends a read-out request with an address information AD(3) to access the repeat data information SAME to the working memory 33, then the repeat data information SAME is transferred from the third register 43 to the central processing unit 31. As described above, the repeat data information SAME is identical with the pointer value (i) indicating the register location where the key code (CR) is stored. For this reason, the central processing unit 31 can produce an address information AD3-(SAME) to access the tone-sustaining flag information SON(SAME) which is sent to the working memory 33 upon a read-out request. The tone-sustaining flag information SON(SAME) is transferred from the working memory 33 to the central processing unit 31, then the central processing unit 31 can decide the logic state of the tone-sustaining flag information SON(SAME). If it is found that the tone-sustaining flag information SON(-SAME) is in the logic "1" state, the player actuated the tone-sustaining pedal 25 upon the first key depression, then the central processing unit executes the key assignation program shown in FIG. 10. When a tone generating channel is assigned to the depressed key CR by execution of the key-assignation program, the central processing unit 31 produces the idle channel data information (ASSCH) and transfers the idle channel data information (ASSCH) to the fourth register 44 for writing-in operation. The central processing unit 31 proceeds to step P256 to execute the following operations. Namely, the central processing unit 31 reads out the event key code data information EVKC from the first register 41 and transfers a key code identical with the event key code data information EVKC to the register of the first temporary data storage 35 related to the assigned tone generating channel for allowing the key code KC(ASSCH) to be identical to the key code KC(CR). The central processing unit 31 further transfers data informations of the logic "1" states to the respective registers of the second and third temporary data storages 36 and 37 for setting the key-on flag information KON(ASSCH) and the tone-sustaining flag information SON(ASSCH) into the logic "1" states, respectively. The key-off count data information KOFCNT(ASSCH) related to the assigned tone generating channel is set to zero. In the step P256, the tone-sustaining flag information is set to the logic "1" state, and, for this reason, the tone-sustaining flag information SON(ASSCH) is identical in logic state with the tone-sustaining flag information SON(SAME). This means that the tone-sustaining effect is imparted to the tone produced by the second key depression. However, if it is found that the tone-sustaining flag information SON(-SAME) is in the logic "0" state, the central processing unit 31 executes the key-assignation program as by step P257 so as to cause to fourth register 44 to store the idle channel data information ASSCH. Then, the central processing unit 31 proceeds to step P258 to provide the key-code KC(x), the logic "1" state, the logic "0" state and hexadecimal number of zero to the respective registers of the first, second, third and fourth temporary data storages 35, 36, 37 and 38, respectively. After execution of the step P256 or P258, the central processing unit 31 executes the data information transfer procedure as by the step P210.

On the other hand, if there are more than two tone generating channels assigned to a single key code KC(CR), the answer in the decision step P253 is in the positive, so that the central processing unit 31 proceeds to step P259 to determine whether or not the key-off count data information KOFCNT(i) is larger in value than the key-off count data information KOFCNT-(SAME). In order to read out the two key-off count data informations KOFCNT(i) and KOFCNT(SAME), the central processing unit 31 reads out the repeat data information SAME from the third register 43 and produces an address information AD(SAME) to access the key-off count data information KOFCNT(SAME). A read-out request with the address information AD(-SAME) is provided to the working memory 33, so that the key-off count data information KOFCNT(SAME) is transferred from the fourth temporary data storage 38 to the central processing unit 31. The central processing unit 31 further produces an address information AD4(i) to access the key-off count data information KOFCN-T(i) on the basis of the pointer value (i). A read-out request with the address information AD4(i) is provided to the working memory 33, so that the key-off count data information KOFCNT(i) is transferred from the fourth temporary data storage 38 to the central processing unit 31 for comparing with the key-off count data information which has been already read out from the fourth temporary data storage 38. As a result of the comparison, if it is found that the key-off count data information KOFCNT(I) is not greater than the key-off count data information KOFCNT(SAME), the key related to the key-off data information KOFCNT-(SAME) is depressed earlier than the key related to the key-off count data information KOFCNT(i), so that the central processing unit 31 changes the idle channel data information ASSCH to a value identical with the repeat data information SAME as by step P260. The central processing unit 31 then proceeds to step P261. In the step P261, the central processing unit 31 reads out the tone-sustaining flag information SON(i) from the third temporary data storage 37 and preserves the logic state of the tone-sustaining flag information SON(i). The central processing unit 31 further reads out the idle channel data information ASSCH from the fourth register 44 and forms an address information AD(4) on the basis of the idle channel data information ASSCH. The central processing unit 31 then provides a write-in request with the address information AS4(ASSCH) followed by a binary data information indicating the logic level of the tone-sustaining flag information SON(ASSCH) and sets the logic state of the tone-sustaining flag information SON(i) to the tone-sustaining flag information SON(ASSCH). However, if it is found that the key-off count data information KOFCNT(i) is greater in value than the key-off count data information KOFCNT(SAME), the key related to the key-off count data information KOFCNT(i) is depressed earlier than the key related to the key-off count data information KOFCNT(SAME), so that the central processing unit 31 provides a write-in request with the address information AD(4) indicating the fourth register 44 followed by the data information identical with the pointer value (i) to the working memory 33, thereby preserving the pointer value (i) in the fourth register 44 as by step P262. The central processing unit 31 thereafter proceeds to step P263 to change the tone-sustaining flag information SON(ASSCH). In the step P263, the central processing unit 31 reads out the tone-sustaining flag information SON(ASSCH) from the third temporary data storage 37 and preserves the logic state of the tone-sustaining flag information SON(ASSCH). The central processing unit 31 further reads out the repeat data information SAME from the third register 43 and forms an address information AD3(SAME) on the basis of the repeat data information SAME. The central processing unit 31 then provides a write-in request with the address information followed by a binary data information indicating the logic level of the tone-sustaining flag information SON(SAME) and sets the logic level of the tone-sustaining flag information SON(ASSCH) to the tone-sustaining flag information SON(SAME). Thus, the central processing unit 31 provides the tone-sustaining data information SON(ASSCH) for second key depression on the basis of the former key depression. After alternative execution, the central processing unit 31 proceeds to step P264. In the step P264, the central processing unit 31 reads out the event key code data information EVKC from the first register 41 and transfers a key code identical with the event key code data information EVKC to the register of the first temporary data storage 35 related to the assigned tone generating channel for allowing the key code KC(ASSCH) to be identical to the key code (CR). The central processing unit 31 further transfers a data information of the logic "1" state to the registers of the second temporary data storage 36 for setting the key-on flag information KON(ASSCH) into the logic "1" states. The key-off count data information KOFCNT(ASSCH) related to the assigned tone generating channel is set to hexadecimal number of zero. After the execution of the step P264, the central processing unit 31 proceeds to the step P210 to execute the data information transfer procedure. The central processing unit 31 compares the key-off count data information KOFCNT(i) with the key-off count data information KOFCNT(SAME) in the step P250, so that the central processing unit 31 can assign the tone-generating channel associated with the larger key-off count data information KOFCNT(i) or KOFCNT(SAME) to a newly depressed key.

If the key CR assigned to the two tone generating channels is released, the central processing unit 31 executes the key-off program. After the step P231, the central processing unit 31 searches the first temporary data storage 35 for a register preserving a key code identical with the event key-code data information EVKC by repeating executions of the loop consisting of the steps P232 to P234. If there is a register preserving the key code identical with the event key-code data information, the central processing unit 31 proceeds to the step P235 as previously described. However, if the answer in the decision step P235 is in the negative, the central processing unit 31 returns to the loop consisting of the steps P232 to P234 to find out the register preserving the key code associated with the key-on flag information of the logic "1" state. If the central processing unit 31 finds out the register, the answers in the decision steps P232 and P235 are in the positive, respectively, so that the central processing unit 31 executes the remaining steps P236 to P240 to complete the key-off program. As the tone-sustaining flag information SON(i) is set in the same state as that previously released, the tone produced upon the second depression is identical in decay time period with the tone produced upon the first depression by the executions of the steps P236 to P240, thereby allowing the second tone to have the tone-sustaining effect even if the single key is repeatedly depressed in the continuous actuation of the tone-sustaining pedal 25.

In this instance, the central processing unit 31 and the steps P202 to P209 as a whole constitute the controller means 3, and the central processing unit 31 and the steps P301 to P305 form in combination the first setting means 7. Moreover, the central processing unit 31 and the steps P204, P250 to P253 and the third register 43 as a whole constitute the searching means 8, and the central processing unit 31 and the steps P210 and P254 to P264 form in combination the second setting means 9. The central processing unit 31 and the steps 198 and 199 as a whole constitute the first activation means, and the central processing unit 31 and the steps 298 and 299 form in combination the second activation means.

Moreover, the electronic musical instrument described above has a sixteen tone generating channel, however it is acceptable to have the tone generating channels different in number from the electronic musical instrument described above. Similarly, it is possible to simultaneously produce more than two tones each having a certain note, and, on the other hand, the number of tones may be limited to only one.

Although particular embodiment of the present invention have been shown and described, it will be obvious to those skilled in the art that various changes and modifications may be made without departing from the spirit and scope of the present invention. For example, the present invention is applicable to another electronic percussion-type musical instrument such as electronic marimba.

What is claimed is:

1. An electronic musical instrument for electronically producing sounds, comprising:

(a) a keyboard having a plurality of keys for producing note information representative of a note of a depressed state key;

(b) first memory means provided with a plurality of first channels each capable of storing said note information;

(c) controller means operative to assign said note information to one of said first channels, said one of said first channels being available to said note information upon assignment;

(d) a sostenuto switch operated by an operator for producing switch state information alternatively representing an activated state and an inactivated state;

(e) second memory means provided with a plurality of second channels for storing sostenuto information alternatively representing a first state and a second state, said first state being representative of a request for imparting a sostenuto effect to a sound produced in accordance with said note information, said second state being representative of the absence of said request;

(f) searching means operative to search, when a key is depressed, said first memory means for a first channel which has already stored note information identical with said note information of said depressed key;

(g) first setting means operative to set to said first state said sostenuto information stored in one of said second channels corresponding to said first channel supplied with said note information when said switch state information is in said activated state, said first setting means further being operative to set to said second state said sostenuto information stored in said one of said second channels when said switch state information is in said inactivated state;

(h) second setting means responsive to said searching means to set said sostenuto information stored in said one of said second channels to the same state as said sostenuto information stored in a second channel corresponding to said first channel which has already stored said note information; and (i) sound generator means operative to produce one of said sounds having the note specified by said note information, said sound generator means further operative to impart said sostenuto effect to said one of said sounds when said sostenuto information stored in said one of said second channels is in the first state.

2. An electronic musical instrument for electronically producing sounds, comprising:

(a) a keyboard having a plurality of keys for producing note information representative of a note of a depressed state key;

(b) first memory means provided with a plurality of first channels each capable of storing said note information;

(c) a controller means operative to assign said note information to one of said first channels, said one of said first channels being available to said note information upon assignment;

(d) a sostenuto switch operated by an operator for producing switch state information alternatively representing an activated state and an inactivated state;

(e) a second memory means provided with a plurality of second channels for storing pieces of sostenuto information, respectively, each representative of a request for imparting a sostenuto effect to a sound produced in accordance with said note information;

(f) first setting means operative to set said piece of sostenuto information stored in one of said second channels corresponding to said note information produced in response to said depressed key state when said switch state information is in said activated state, said first setting means further being operative to reset said piece of sostenuto information stored in said one of said second channels when said switch state information is in said inactivated state; and (g) sound generator means operative to produce one of said sounds having the note specified by said note information, said sound generator means further operative to impart said sostenuto effect to said one of said sounds when said piece of sostenuto information stored in said activated state in said one of said second channels corresponding to said note information.

* * * * *